US010107112B2

(12) United States Patent
Smarsly

(10) Patent No.: US 10,107,112 B2
(45) Date of Patent: Oct. 23, 2018

(54) METHOD FOR PRODUCING FORGED COMPONENTS FROM A TIAL ALLOY AND COMPONENT PRODUCED THEREBY

(71) Applicant: MTU Aero Engines AG, Munich (DE)

(72) Inventor: Wilfried Smarsly, Munich (DE)

(73) Assignee: MTU AERO ENGINES AG, Munich (DE)

( * ) Notice: Subject to any disclaimer, the term of this patent is extended or adjusted under 35 U.S.C. 154(b) by 1003 days.

(21) Appl. No.: 14/374,260

(22) PCT Filed: Jan. 19, 2013

(86) PCT No.: PCT/DE2013/000037

§ 371 (c)(1),
(2) Date: Jul. 24, 2014

(87) PCT Pub. No.: WO2013/110260

PCT Pub. Date: Aug. 1, 2013

(65) Prior Publication Data

US 2014/0369822 A1 Dec. 18, 2014

(30) Foreign Application Priority Data

Jan. 25, 2012 (DE) ..... 10 2012 201 082

(51) Int. Cl.
*C22F 1/18* (2006.01)
*C22C 14/00* (2006.01)
(Continued)

(52) U.S. Cl.
CPC ..... *F01D 5/28* (2013.01); *C22C 14/00* (2013.01); *C22F 1/183* (2013.01); *F01D 9/02* (2013.01);
(Continued)

(58) Field of Classification Search
CPC ..... C22F 1/183; C22C 14/00; F01D 5/28
(Continued)

(56) References Cited

U.S. PATENT DOCUMENTS 5,558,729 A 9/1996 Kim et al.
5,746,846 A 5/1998 Kim et al.
(Continued)

FOREIGN PATENT DOCUMENTS

DE 19756354 A1 6/1999
EP 0889143 A1 1/1999
(Continued)

OTHER PUBLICATIONS

Clemens et al.: Intermetallic Titanium Aluminide—An Innovative Low-weight Material for High-temperature Applications; BHM Berg- und Huettenmaennische Monatshefte; Zeitschrift fuer Rohstoffe, Geotechnik, Metallurgie, Werkstoffe, Maschinen- und Anlagentechnik, Springer Verlag, Vienna, vol. 156, No. 7., Jul. 1, 2011.
(Continued)

*Primary Examiner* — George Wyszomierski
*Assistant Examiner* — Janelle Morillo
(74) *Attorney, Agent, or Firm* — Abel Law Group, LLP

(57) ABSTRACT

The invention relates to a method for producing a component from a TiAl alloy, wherein the component is shaped by forging, in particular isothermal forging, and is subsequently subjected to at least one heat treatment, wherein in the first heat treatment the temperature is between 1100 and 1200° C. and is maintained for 6 to 10 hours and then the component is cooled.

18 Claims, 1 Drawing Sheet

(51) Int. Cl.
*F01D 5/28* (2006.01)
*F01D 9/02* (2006.01)

(52) U.S. Cl.
CPC ..... *F05D 2230/25* (2013.01); *F05D 2230/40* (2013.01); *F05D 2230/41* (2013.01); *F05D 2300/174* (2013.01)

(58) Field of Classification Search
USPC ..... 148/669, 671
See application file for complete search history.

(56) References Cited

U.S. PATENT DOCUMENTS

| | | | |
|---|---|---|---|
| 5,997,808 | A | 12/1999 | Jones et al. |
| 6,521,059 | B1 | 2/2003 | Nazmy et al. |
| 6,997,995 | B2 | 2/2006 | Janschek et al. |
| 8,828,160 | B2 | 9/2014 | Kremmer et al. |
| 8,864,918 | B2 | 10/2014 | Clemens et al. |
| 2004/0094248 | A1 | 5/2004 | Janschek et al. |
| 2010/0329877 | A1 | 12/2010 | Kremmer et al. |
| 2011/0277891 | A1 | 11/2011 | Clemens et al. |

FOREIGN PATENT DOCUMENTS

| | | | |
|---|---|---|---|
| EP | 2272993 | A1 | 1/2011 |
| EP | 2386663 | A1 | 11/2011 |
| WO | 0248420 | A2 | 6/2002 |

OTHER PUBLICATIONS

Schmoelzer T et al: Phase fractions, transition and ordering temperatures in TiAl—Nb—Mo alloys: An in- and ex-situ study, Intermetallics, Elsevier Science Publishers B.V. GB, vol. 18, No. 8, Aug. 1, 2010.

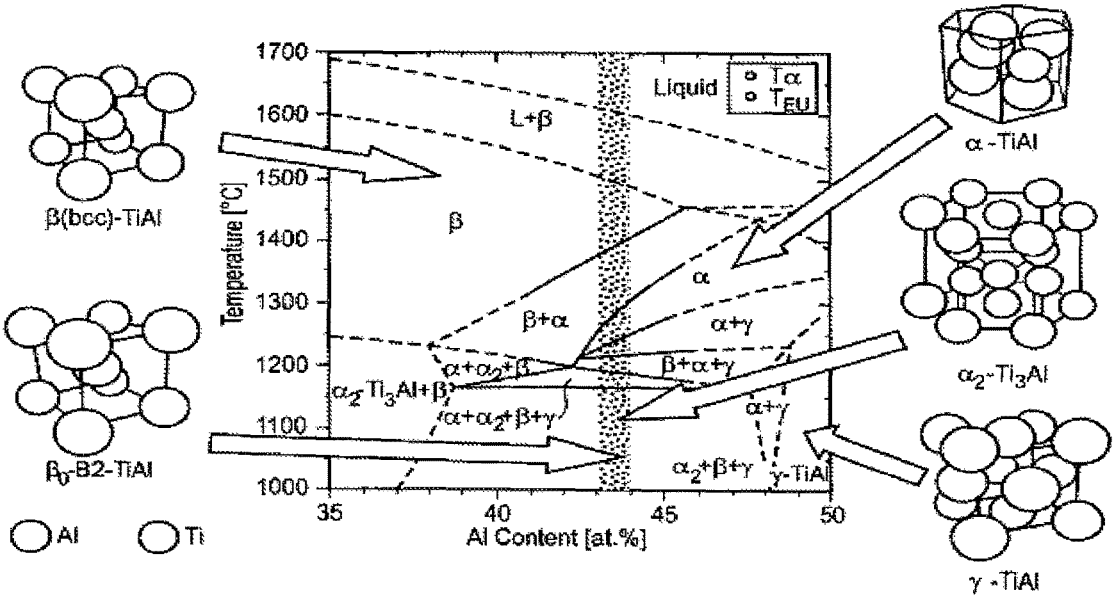
β(bcc)-TiAl
β0-B2-TiAl
Al
Ti
1700
1600
1500
1400
1300
1200
1100
1000
Temperature [°C]
35
40
45
50
Al Content [at.%]
Liquid
Tα
TEU
L+β
β
β+α
α
α+γ
α+α2+β
β+α+γ
α2-Ti3Al+β
α+α2+β+γ
α+γ
α2+β+γ
γ-TiAl
α-TiAl
α2-Ti3Al
γ-TiAl

METHOD FOR PRODUCING FORGED COMPONENTS FROM A TIAL ALLOY AND COMPONENT PRODUCED THEREBY

BACKGROUND OF THE INVENTION

Field of the Invention

The present invention relates to a method for producing a component from a TiAl alloy, in which the component is shaped by forging, in particular by isothermal forging, and is subsequently subjected to a heat treatment. In addition, the present invention relates to a component produced thereby.

Discussion of Background Information

TiAl alloys, the main constituents of which are titanium and aluminum, are distinguished by the fact that they have a high strength, in particular high-temperature strength, combined with an adequate ductility owing to the formation of intermetallic phases, for example γ-TiAl, which have a high proportion of covalent bonding forces within the metallic bond. In addition, they have a low specific weight, and therefore the use of the titanium aluminides or of TiAl alloys is suitable for high-temperature applications, for example for turbomachines, in particular gas turbines or aero engines.

The property profile of the TiAl alloys can be optimized further by adding certain alloying constituents, for example niobium and molybdenum. Alloys of this type with a niobium and molybdenum content are also referred to as TNM alloys.

These alloys are used in aero engines, for example as guide vanes or rotor blades, and are given the appropriate component shape by forging. In particular, use can be made here of isothermal forging with subsequent heat treatment for setting the microstructure and the property profile. In this way, it is also possible to produce single-part blade-disk units, what are termed blisks (coinage for blade and disk).

However, differences in the chemical composition over the component can lead, during production, to a different phase composition within a component made of a TiAl material; this results in a non-uniform distribution of the property profile in the component, and therefore corresponding variations in the properties over the component mean that components of this type can no longer be used if they lie outside the predefined specification for the component. This leads to high reject rates.

DISCLOSURE OF THE INVENTION

Object of the Invention

It is an object of the present invention, therefore, to specify a method for producing components from a TiAl alloy using a forging production method, in which the problems of the prior art, in particular in view of inhomogeneous properties of the component, can be remedied and in particular a component can be produced from a TiAl alloy in a simple manner with a desired property profile, it being possible primarily to respond to the specific chemical composition and the variation thereof in the component.

Technical Solution

This object is achieved by a method for producing a component and also by a component as recited in the instant independent claims. Advantageous configurations are the subject matter of the dependent claims.

According to the present invention, it is proposed, in the case of a component which has been produced by forging and is made of a TiAl alloy, i.e. an alloy in which the alloying constituents with the highest proportion of the alloy composition are titanium and aluminum, to carry out, after the forging, at least a first heat treatment, in which, at least in one method step, the component is at a temperature of between 1100° C. and 1200° C. for 6 to 10 hours and is then cooled.

The TiAl material undergoes partial segregation owing to the preceding production steps. This first heat treatment is referred to as homogenization annealing, since it homogenizes the material composition over the component and disintegrates existing concentration sites. The cooling rate here can be between 1° C./s and 5° C./s.

In a preferred first embodiment, the component is heated in a second heat treatment above the solvus line of γ-TiAl. By virtue of a second heat treatment of this nature, the γ-TiAl present in the microstructure is transformed at least partially into another solid phase, e.g. α-TiAl, such that a desired or adapted phase composition in the TiAl alloy is made possible and in particular by varying the phase composition it is possible to set optimum mechanical properties, in particular with respect to the overall expansion and the creep strength, depending on the chemical composition of the component. The heat treatment in this respect can be matched specifically to the specific chemical composition and the variation thereof in the component. Compared to the procedure to date, in which a heat treatment for the recreation of the microstructure has likewise been carried out after the forging, there is a change in the phase composition upon age-hardening of the component at a temperature above the solvus line of the γ-TiAl in the corresponding phase diagram, and this makes it possible to variably set the mechanical properties of the component. This second heat treatment is referred to as recrystallization annealing.

After the second heat treatment above the solvus line of the γ-TiAl, the component can be rapidly cooled, in order to largely freeze the phase composition set at the heat treatment temperature. Rapid cooling can be effected, for example, by quenching in water or oil or by air cooling using a fan.

The cooling can be effected so rapidly that a transformation of α-TiAl additionally formed during the second heat treatment into a lamellar structure of α-TiAl and γ-TiAl is avoided.

In addition, the second heat treatment can be carried out at a temperature at which passage into a single-phase phase field of the TiAl phase diagram, for example the α-TiAl phase field, is avoided, in order to prevent the risk of coarse grain growth which arises during a heat treatment in a single-phase phase field.

The second heat treatment can be carried out over a period of time which ensures adequate transformation of the γ-TiAl into another phase, in particular α-TiAl, such that the desired phase composition can be achieved.

The temperature during the second heat treatment above the γ-TiAl solvus line can be chosen to be at a temperature of 20° C. to 50° C., in particular 25° C. to 35° C., preferably about 30° C. above the γ-TiAl solvus line.

The method can be used in particular for components which consist of a TiAl alloy comprising 42 to 45 at. % titanium, in particular 42.5 to 54.5 at. % titanium, 3.5 to 4.5 at. % niobium, in particular 4.0 to 4.2 at. % niobium, 0.75 to 1.5 at. % molybdenum, in particular 0.9 to 1.2 at. % molybdenum, and 0.05 to 0.15 at. % boron, in particular 0.1 to 0.12 at. % boron, remainder aluminum and unavoidable impurities. In the case of such an alloy, there is a phase composition with appropriate proportions of the γ-TiAl, which renders the use of the method according to the invention particularly advantageous.

As an alternative to the second heat treatment mentioned above, in the second preferred embodiment the second heat treatment can be carried out at a temperature below the γ-TiAl solvus line, the temperature lying in particular between 12° C. and 18° C. below the solvus line.

In a preferred embodiment, it is additionally possible to carry out a third heat treatment in the temperature range of 800° C. to 950° C. for 5 to 7 hours, in order to stabilize the material microstructure in the component (stabilization annealing).

A corresponding method can be used to produce components of a turbomachine, in particular of a gas turbine or of an aero engine, in particular rotor blades, guide vanes or turbine blisks, which have a variably settable property profile on account of an adapted phase composition.

BRIEF DESCRIPTION OF THE DRAWING

The accompanying drawing in the single Figure shows what is termed a TNM phase diagram for a material with which the present invention can be implemented.

EXEMPLARY EMBODIMENT

A material for a component produced according to the invention can have, for example, a composition in the range of 42 to 45 at. % titanium, 3.5 to 4.5 at. % niobium, 0.75 to 1.5 at. % molybdenum, and 0.05 to 0.15 at. % boron, remainder aluminum and unavoidable impurities. A corresponding component can be subjected, for example, to isothermal forging, until it has the rough contour of the component which is ultimately to be produced.

Firstly, the material of the component is homogenized by a first heat treatment at, for example, 1150° C. for 8 hours.

In a first alternative of a second heat treatment, the component can then be annealed at a temperature of for example, 1290° C. (i.e. above the solvus line (1)) for a predetermined period of time, in order to bring about partial transformation of the γ-TiAl to α-TiAl, so that α-TiAl and γ-TiAl are present alongside one another in the microstructure. The heat treatment here can be carried out until a sufficient quantity of γ-TiAl has been transformed into α-TiAl for the desired phase composition.

Then, the component is rapidly cooled, for example by quenching in water (10 min) or in oil or by cooling using a fan. This fan cooling is effected in a furnace, with the temperature being lowered to 850° C. and being maintained for 6 hours.

As a result, the α-TiAl and γ-TiAl microstructure set at the temperature of the second heat treatment, i.e. at a temperature of 1290° C., is largely frozen, and transformation of the a phase into α/γ lamellae is avoided. The choice of the heat treatment temperature at 1290° C. additionally avoids complete transformation of the γ-TiAl into α-TiAl, which in the case of a corresponding heat treatment would lead to the risk of coarse grain growth.

In a second alternative for the second heat treatment, the component is heated below the solvus line (1). By way of example, the component is heated at 1235° C. for one hour, and then the component is cooled (with water, oil or furnace cooling). For the furnace cooling, the temperature is lowered to 850° C. and is maintained for 6 hours.

Although the present invention has been described in detail on the basis of the exemplary embodiment, it is clear to a person skilled in the art that modifications are possible in such a way that individual features can be omitted or differing combinations of features can be realized without departing from the scope of protection of the claims. In particular, the disclosure of the present invention incorporates all combinations of the individual features presented.

What is claimed is:

1. A method for producing a component from a TiAl alloy, wherein the method comprises shaping the component by forging and subsequently subjecting the component to at least two heat treatments and wherein in a first heat treatment a temperature of from 1100° C. to 1200° C. is maintained for 6 to 10 hours, whereafter the component is cooled at a cooling rate of from 1° C./s to 5° C./s, and wherein in a second heat treatment the component is heated to a temperature above a solvus line of γ-TiAl.

2. The method of claim 1, wherein after the second heat treatment the component is cooled so rapidly that a transformation of α-TiAl into a lamellar structure of α-TiAl and γ-TiAl is suppressed.

3. The method of claim 1, wherein the TiAl alloy comprises from 42 to 45 at. % Ti, from 3.5 to 4.5 at. % Nb, from 0.75 to 1.5 at. % Mo, and from 0.05 to 0.15 at. % B, remainder aluminum and unavoidable impurities.

4. The method of claim 3, wherein the TiAl alloy comprises from 42.5 to 44.5 at. % Ti, from 4 to 4.2 at. % Nb, from 0.9 to 1.2 at. % Mo, and from 0.1 to 0.12 at. % B.

5. The method of claim 1, wherein the method further comprises a third heat treatment for stabilization in a temperature range of from 800° C. to 950° C. for from 5 to 7 hours.

6. A method for producing a component from a TiAl alloy, wherein the method comprises shaping the component by forging and subsequently subjecting the component to at least two heat treatments and wherein in a first heat treatment a temperature of from 1100° C. to 1200° C. is maintained for 6 to 10 hours, whereafter the component is cooled, and wherein in a second heat treatment the component is heated to either (a) a temperature which is from 20° C. to 50° C. above a solvus line of γ-TiAl or (b) a temperature which is from 12° C. to 18° C. below the solvus line of γ-TiAl.

7. The method of claim 6, wherein the second heat treatment is heat treatment (a).

8. The method of claim 7, wherein after the second heat treatment the component is rapidly cooled by quenching in water or oil or by air cooling using a fan.

9. The method of claim 8, wherein after the second heat treatment the component is cooled so rapidly that a transformation of α-TiAl into a lamellar structure of α-TiAl and γ-TiAl is suppressed.

10. The method of claim 7, wherein during the second heat treatment the temperature is from 25° C. to 35° C. above the solvus line.

11. The method of claim 6, wherein the TiAl alloy comprises from 42 to 45 at. % Ti, from 3.5 to 4.5 at. % Nb, from 0.75 to 1.5 at. % Mo, and from 0.05 to 0.15 at. % B, remainder aluminum and unavoidable impurities.

12. The method of claim 11, wherein the TiAl alloy comprises from 42.5 to 44.5 at. % Ti, from 4 to 4.2 at. % Nb, from 0.9 to 1.2 at. % Mo, and from 0.1 to 0.12 at. % B.

13. The method of claim 6, wherein the method further comprises a third heat treatment for stabilization in a temperature range of from 800° C. to 950° C. for from 5 to 7 hours.

14. The method of claim 6, wherein the second heat treatment is heat treatment (b).

15. A method for producing a component from a TiAl alloy, wherein the method comprises shaping the component by forging and subsequently subjecting the component to at least one heat treatment and wherein in a first heat treatment a temperature of from 1100° C. to 1200° C. is maintained for 6 to 10 hours, whereafter the component is cooled, and wherein the TiAl alloy consists of from 42 to 45 at. % Ti, from 3.5 to 4.5 at. % Nb, from 0.75 to 1.5 at. % Mo, and from 0.05 to 0.15 at. % B, remainder aluminum and unavoidable impurities.

16. The method of claim 15, wherein the TiAl alloy consists of from 42.5 to 44.5 at. % Ti, from 4 to 4.2 at. % Nb, from 0.9 to 1.2 at. % Mo, and from 0.1 to 0.12 at. % B, remainder aluminum and unavoidable impurities.

17. The method of claim 15, wherein in a second heat treatment the component is heated to a temperature above a solvus line of γ-TiAl.

18. The method of claim 15, wherein in a second heat treatment the component is heated to a temperature below a solvus line of γ-TiAl.

* * * * *